US008739873B2

(12) United States Patent
Rogers et al.

(10) Patent No.: US 8,739,873 B2
(45) Date of Patent: Jun. 3, 2014

(54) SYSTEM AND METHOD FOR FLUID DIVERSION AND FLUID ISOLATION

(75) Inventors: Henry E. Rogers, Duncan, OK (US); Steve L. Holden, Fletcher, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 802 days.

(21) Appl. No.: 12/718,761

(22) Filed: Mar. 5, 2010

(65) Prior Publication Data

US 2011/0214861 A1 Sep. 8, 2011

(51) Int. Cl.

| | |
|---|---|
| ***E21B 33/13*** | (2006.01) |
| ***E21B 23/00*** | (2006.01) |
| ***E21B 33/12*** | (2006.01) |
| ***E21B 43/00*** | (2006.01) |

(52) U.S. Cl.
USPC ..... 166/281; 166/119; 166/191; 166/177.4

(58) Field of Classification Search
USPC ..... 166/116, 119, 153, 154, 156, 158, 191, 166/196, 177.3, 296, 202, 281, 177.4
See application file for complete search history.

(56) References Cited

U.S. PATENT DOCUMENTS

| | | | | |
|---|---|---|---|---|
| 2,674,315 | A * | 4/1954 | Brown | 166/119 |
| 2,836,252 | A * | 5/1958 | Lane | 277/338 |
| 3,039,534 | A * | 6/1962 | Koop | 166/123 |
| 3,131,767 | A * | 5/1964 | Chancellor et al. | 166/154 |
| 3,570,603 | A * | 3/1971 | Kammerer et al. | 166/290 |
| 3,789,926 | A | 2/1974 | Henley et al. | |
| 3,948,322 | A * | 4/1976 | Baker | 166/289 |
| 4,066,125 | A * | 1/1978 | Bassani | 166/202 |
| 4,287,948 | A * | 9/1981 | Haggard | 166/170 |
| 4,407,369 | A * | 10/1983 | Hutchison et al. | 166/291 |
| 4,431,058 | A * | 2/1984 | Spencer et al. | 166/312 |
| 4,531,583 | A | 7/1985 | Revett | |
| 4,665,978 | A * | 5/1987 | Luke | 277/340 |

(Continued)

FOREIGN PATENT DOCUMENTS

| | | | |
|---|---|---|---|
| EP | 1340882 | A2 | 9/2003 |
| WO | 2011107745 | A2 | 9/2011 |
| WO | 2011107745 | A3 | 9/2011 |

OTHER PUBLICATIONS

BJ Services brochure entitled "Para-Bow(TM) cementing tool," Jul. 2008, 4 pages, BJ Services Company.

(Continued)

*Primary Examiner* — Kenneth L Thompson
*Assistant Examiner* — Michael Wills, III
(74) *Attorney, Agent, or Firm* — John Wustenberg; Conley Rose, P.C.

(57) ABSTRACT

A method of cementing a wellbore, comprising delivering a diversion and movable isolation tool into the wellbore and thereby at least partially isolating a first wellbore volume from a second wellbore volume, the second wellbore volume being uphole relative to the first wellbore volume, passing fluid through the diversion and movable isolation tool into the first wellbore volume, substantially discontinuing the passing of fluid through the diversion and movable isolation tool into the first wellbore volume, passing fluid through the diversion and movable isolation tool into the second wellbore volume. A diversion and movable isolation tool for a wellbore, comprising a body comprising selectively actuated radial flow ports, and a fluid isolation assembly, comprising one or more segments, each segment comprising a central ring and at least one tab extending from the central ring.

31 Claims, 9 Drawing Sheets

(56) References Cited

U.S. PATENT DOCUMENTS

| | | | | | |
|---|---|---|---|---|---|
| 4,869,325 | A | * | 9/1989 | Halbardier | 166/387 |
| 4,961,465 | A | * | 10/1990 | Brandell | 166/184 |
| 5,117,910 | A | * | 6/1992 | Brandell et al. | 166/291 |
| 5,195,584 | A | * | 3/1993 | Basinger, Jr. | 166/191 |
| 5,295,279 | A | * | 3/1994 | Cooper | 15/104.061 |
| 5,318,118 | A | * | 6/1994 | Duell | 166/202 |
| 5,368,103 | A | | 11/1994 | Heathman et al. | |
| 5,566,757 | A | | 10/1996 | Carpenter et al. | |
| 5,579,843 | A | * | 12/1996 | Loitherstein | 166/278 |
| 5,667,015 | A | | 9/1997 | Harestad et al. | |
| 5,732,774 | A | * | 3/1998 | Haggard | 166/153 |
| 5,787,982 | A | * | 8/1998 | Bakke | 166/242.6 |
| 5,803,177 | A | * | 9/1998 | Hriscu et al. | 166/305.1 |
| 6,082,451 | A | | 7/2000 | Giroux et al. | |
| 6,082,459 | A | | 7/2000 | Rogers et al. | |
| 6,182,766 | B1 | | 2/2001 | Rogers et al. | |
| 6,454,001 | B1 | * | 9/2002 | Thompson et al. | 166/250.14 |
| 6,622,798 | B1 | | 9/2003 | Rogers et al. | |
| 6,772,835 | B2 | | 8/2004 | Rogers et al. | |
| 6,880,636 | B2 | | 4/2005 | Rogers et al. | |
| 7,004,248 | B2 | * | 2/2006 | Hoffman et al. | 166/191 |
| 7,152,674 | B2 | * | 12/2006 | Bowles | 166/242.6 |
| 7,472,752 | B2 | | 1/2009 | Rogers et al. | |
| 7,735,552 | B2 | * | 6/2010 | Xu | 166/202 |
| 2004/0149429 | A1 | * | 8/2004 | Dilber et al. | 166/134 |
| 2005/0087338 | A1 | * | 4/2005 | Parker | 166/242.6 |
| 2007/0261863 | A1 | * | 11/2007 | Macleod et al. | 166/387 |
| 2008/0164029 | A1 | * | 7/2008 | Rogers et al. | 166/290 |
| 2009/0151960 | A1 | * | 6/2009 | Rogers et al. | 166/386 |
| 2010/0084141 | A1 | * | 4/2010 | Gazewood | 166/377 |

OTHER PUBLICATIONS

Harestad, Kristian, "Cement support tool (CST)," May 24, 2006, 27 pages, Perigon.

Perigon brochure entitled "Avoid cement plug support failure with Cement Support Tool(TM)," undated but admitted to be prior art, 1 page, Perigon.

Perigon brochure entitled "CST(TM) running procedure," undated but admitted to be prior art, 1 page, Perigon.

Foreign communication from a related counterpart application—International Preliminary Report on Patentability, PCT/GB2011/000298, Sep. 11, 2012, 7 pages.

Foreign communication from a related counterpart application—International Search Report and Written Opinion, PCT/GB2011/000298, Apr. 10, 2012,10 pages.

* cited by examiner

SYSTEM AND METHOD FOR FLUID DIVERSION AND FLUID ISOLATION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to systems and methods of cementing a wellbore.

BACKGROUND OF THE INVENTION

It is sometimes necessary to form a cement plug within a wellbore. Some existing systems of forming a cement plug within a wellbore permit undesirable intermingling of the cement with fluid adjacent the cement. While some existing systems are capable of substantially isolating cement from adjacent fluids, some of those systems accomplish such isolation by providing a mechanical zone isolation device at a substantially fixed location along a longitudinal length of the wellbore.

SUMMARY OF THE INVENTION

Disclosed herein is a method of cementing a wellbore, comprising delivering a diversion and movable isolation tool into the wellbore and thereby at least partially isolating a first wellbore volume from a second wellbore volume, the second wellbore volume being uphole relative to the first wellbore volume, passing fluid through the diversion and movable isolation tool into the first wellbore volume, substantially discontinuing the passing of fluid through the diversion and movable isolation tool into the first wellbore volume, passing fluid through the diversion and movable isolation tool into the second wellbore volume.

Also disclosed herein is a diversion and movable isolation tool for a wellbore, comprising a body comprising selectively actuated radial flow ports, and a fluid isolation assembly, comprising one or more segments, each segment comprising a central ring and at least one tab extending from the central ring.

Further disclosed herein is a method of cementing a wellbore, comprising diverting a fluid flow from a first wellbore volume to a second wellbore volume using a diversion and movable isolation tool, and providing a physical barrier between the first wellbore volume and the second wellbore volume using the diversion and movable isolation tool, the physical barrier being movable within the wellbore to remain between the first wellbore volume and the second wellbore volume despite changes in fluid volumes of the first wellbore volume.

DETAILED DESCRIPTION OF THE PREFERRED EMBODIMENTS

Figure 1:
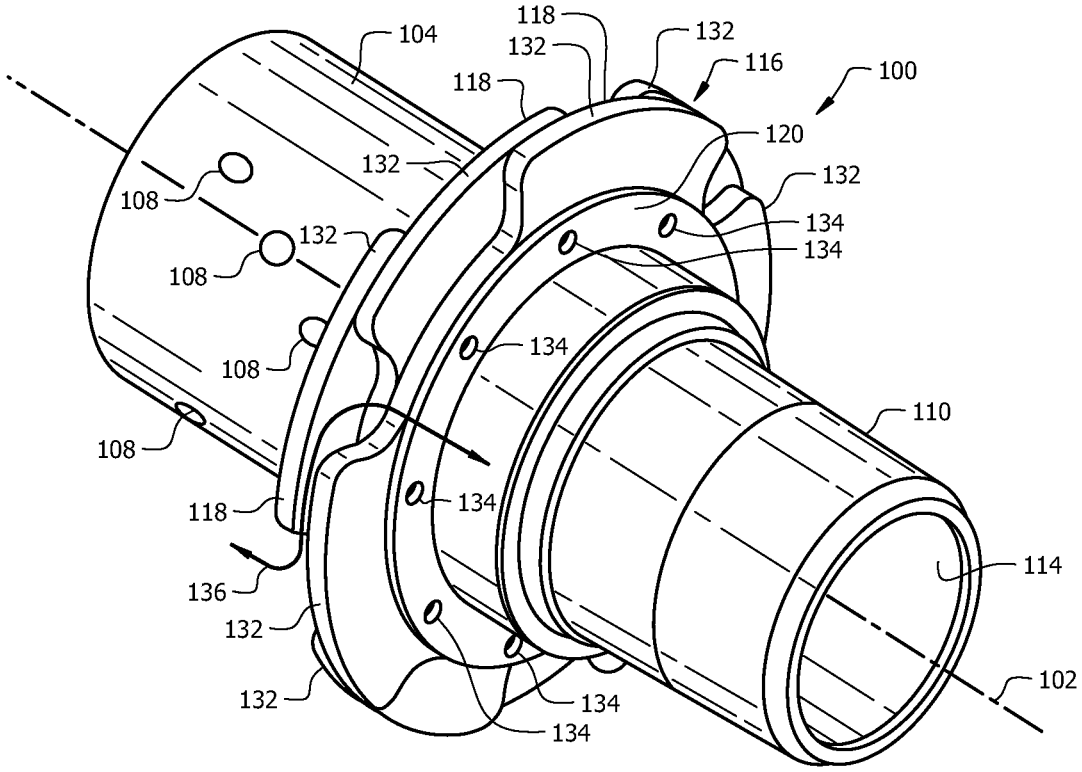
FIG. 1 is an oblique view of a diversion and movable isolation tool (DMIT) according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are systems and methods for selective fluid diversion and/or selective fluid isolation, systems and methods described herein may be used to form a cement plug within a wellbore using a diversion and movable isolation tool (DMIT). As explained in greater detail below, a DMIT may be configured to operate in a pass through mode where fluid may pass through a longitudinal internal bore of the DMIT. In some embodiments, upon selective introduction of an obturator (e.g., a ball, dart, and/or plug) a DMIT may be configured for selective operation in a ported mode where fluid may pass through radial ports of the DMIT between the internal bore of the DMIT to an annular space exterior to the DMIT. In some embodiments, a DMIT may be used to form a longitudinal cement plug within a wellbore. In some embodiments, the longitudinal cement plug formed by the DMIT may be located uphole of a loss zone and/or loss feature of the wellbore. In other embodiments, a DMIT may be used to form a movable cement plug that may migrate downhole to plug loss features of the wellbore and/or associated subterranean formation. In some embodiments, the DMIT may comprise a fluid isolation assembly comprising one or more flexible elements configured to at least partially seal against an interior surface of a wellbore and/or a tubular, pipe, and/or casing disposed in a wellbore, such as, but not limited to, a production tubing and/or casing string.

Figure 2:
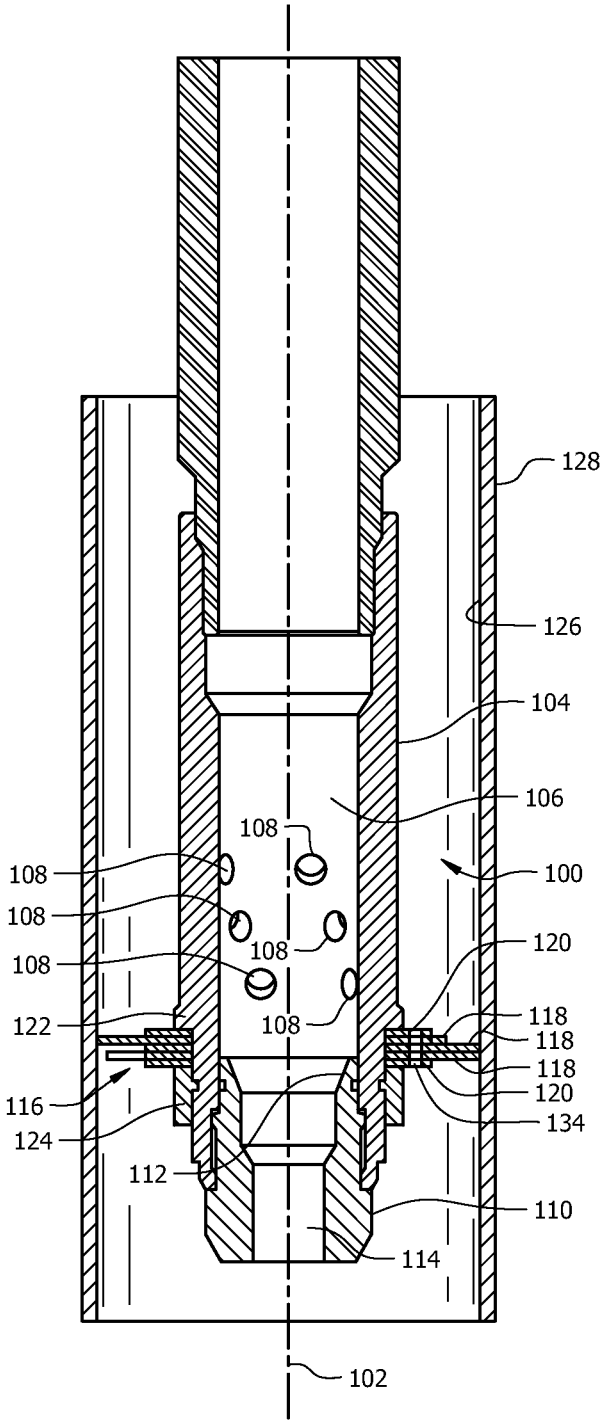
FIG. 2 is a cross-sectional view of the DMIT of FIG. 1.

Referring now to FIGS. 1 and 2, FIG. 1 is an oblique view and FIG. 2 is a cross-sectional view of a DMIT 100 according to an embodiment. Most generally, the DMIT 100 is configured for delivery downhole into a wellbore using any suitable delivery component, including, but not limited to, using coiled tubing and/or any other suitable delivery component of a workstring that may be traversed within the wellbore along a length of the wellbore. In some embodiments, the delivery component may also be configured to deliver a fluid pressure applied to the DMIT 100. Still further, the delivery component may be configured to selectively deliver an obturator (e.g., a ball, dart, plug, etc.) for interaction with the DMIT 100 as described below.

The DMIT 100 generally comprises a longitudinal axis 102 about which many of the components of the DMIT 100 are coaxially disposed and/or aligned therewith. The DMIT 100 comprises a body 104 that is generally a tubular member having a body bore 106 and a plurality of radial ports 108. In this embodiment, the body 104 is configured for connection to a nose 110 comprising a seat 112 exposed to the body bore 106. The nose 110 further comprises a nose bore 114 in selective fluid communication with the body bore 106, dependent upon whether an obturator is seated against seat 112. The body 104 and the nose 110 cooperate to provide a flow through flow path that allows fluid to pass through the DMIT 100 through the body bore 106 and the nose bore 114. However, when an obturator is successfully introduced into sealing engagement with the seat 112, fluid is restricted from flowing in the above-described flow through flow path, but instead, fluid introduced into the body bore 106 may pass out of the body bore 106 through the radial ports 108. The DMIT 100 may be described as operating in a flow through mode when fluid is allowed to pass through the DMIT 100 unobstructed by an obturator. The DMIT may also be described as operating in a diversion mode when fluid is diverted through the radial ports 108 rather than through nose bore 114 in response to obstruction by an obturator interacting with the seat 112.

The DMIT 100 further comprises a fluid isolator assembly (FIA) 116. The FIA 116 comprises a plurality of generally stacked flexible segments 118. In this embodiment, the FIA 116 comprises three segments 118. In this embodiment, the segments 118 are sandwiched between two retainer rings 120. In this embodiment, the retainer rings are captured between an exterior shoulder 122 of the body 104 and a lock ring 124 that engages the exterior of the body 104. Most generally, the FIA 116 may be provided with an overall diameter suitable for contacting an interior surface of a wellbore and/or a tubular of a wellbore. As shown in FIG. 2, in this embodiment, the FIA 116 is shown as being configured to contact an interior surface 126 of a casing 128 of a wellbore.

Figure 3:
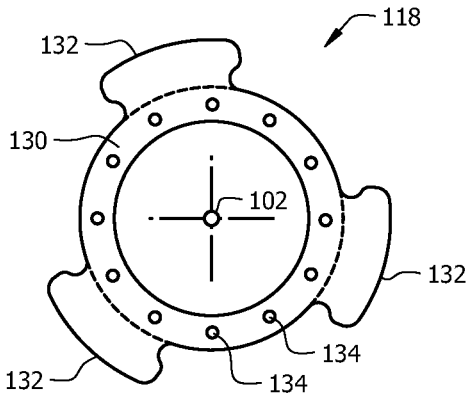
FIG. 3 is an orthogonal top view of a segment of the DMIT of FIG. 1.

Referring now to FIG. 3, an orthogonal top view of a single segment 118 is shown in association with longitudinal axis 102. In this embodiment of a FIA 116, each of the segments 118 are substantially the same in form and structure. Particularly, in this embodiment, each segment 118 generally comprises a central ring 130 that may lie substantially coaxial with longitudinal axis 102. Further, each segment 118 comprises three tabs 132 that extend radially from the central ring 130. In this embodiment, each segment 118 may be formed by stamping the segments 118 from a sheet of rubber. Of course, in other embodiments, any other suitable material may be used and/or the segments may not be integral in formation, but rather, may comprise multiple components to create a single segment 118. In this embodiment, the tabs 132 are substantially equally angularly dispersed about the longitudinal axis 102 to form a uniform radial array of tabs 132 about the longitudinal axis 102. Of course, in other embodiments, the segments 118 may comprise more or fewer tabs 132, differently shaped tabs 132, and/or the tabs 132 may be unevenly angularly spaced about the longitudinal axis 102. In some embodiments, the various tabs 132 of the various segments 118 may be provided with unequal lengths of radial extension as measured from the longitudinal axis 102. Regardless the particular configuration of the various possible embodiments, the FIA 116 may be provided with a combination of segments 118 configured to provide sufficient stiffness and biasing against the interior surface 126 to accomplish the selective fluid isolation described in greater detail below.

In this embodiment, each segment 118 of the FIA 116 is configured to comprise a plurality of assembly holes 134. In this embodiment, the retainer rings 120 comprise a substantially similar arrangement of assembly holes 134. As such, the retainer rings 120 and the segments 118 may be assembled by aligning the rings 120 and segments 118 with each other and angularly rotating the rings 120 and the segments 118 until the assembly holes 134 of the various rings 120 and segments 118 are also aligned. Once the holes 134 are aligned, fasteners may be used to selectively retain the segments 118 and rings 120 relative to each other. In this embodiment the three segments 118 (each having three tabs 132 angularly offset from adjacent tabs 132 by about 120 degrees) are fixed so that the three segments do not share identical radial footprints as viewed from above. In other words, the three segments 118 are not simply stacked to appear from above as a single segment 118 or simply to appear from any other view as merely a thickened segment 118. Instead, adjacent segments 118 of FIA 116 may be described as being assembled according to a rotational convention. In this embodiment of the FIA 116, the rotational convention comprises assembling and/or establishing a first angular location of a segment 118 about the longitudinal axis 102. A next segment 118 to be adjacent the established segment 118 may be rotated in a selected rotational direction (e.g., either clockwise or counterclockwise about the longitudinal axis 102) by about 40 degrees. The third and final segment 118 may be described as being rotated either (1) relative to the first established segment 118 by 80 degrees in the same rotational direction or (2) relative to the second established segment 118 by 40 degrees.

Of course, in other embodiments of a FIA 116, segments 118 may be assembled according to different rotational conventions, including, but not limited to, rotational conventions where adjacent segments 118 are located relative to each other by uneven amounts of angular rotation, randomly generated amounts of angular rotation, and/or pseudo randomly generated amounts of angular rotation. However, it will be appreciated that where segments 118 of other embodiment likewise comprise substantially identical shapes and comprise tabs 132 that are likewise evenly angularly distributed, an increased amount of angular sweep contact between the FIA 116 and the interior surface may be accomplished by angularly offsetting adjacent segments 118 by a number of degrees calculated as $$\left(\frac{360^\circ}{\text{number_of_segments} * \text{number_of_tabs_per_segment}}\right).$$

For example, in an alternative embodiment comprising 5 segments 118 having 5 tabs 132 per segment, adjacent segments 118 may be assembled to be angularly offset from each other by about 14.4 degrees (=360 degrees/5segments*5tabs per segment). Of course, in still other embodiments, some adjacent identical segments 118 may be located so that there is no relative angular rotation. Such an arrangement may be beneficial in increasing a stiffness of the FIA 116.

In some embodiments, the relative location of adjacent segments 118 of a FIA 116 may be selected to provide an FIA fluid flowpath 136 (FFF). Depending on the number of segments 118 and the arrangement of the segments 118 relative to each other, an FFF 136 may comprise any of numerous cross-sectional areas (resulting in different FFF 136 volumes) and curvatures relative to the longitudinal axis 102. In effect, an FFF 136 of desired fluid capacity and curvature may be provided by providing segments 118 having shapes and relative locations within a FIA 116 to result in the desired FFF 136 parameters. Most generally, an FFF 136 provides a fluid path through the FIA 116 that allows passage of fluid between a space uphole of the FIA 116 and a space downhole of the FIA 116. An FFF 136 may be beneficial by reducing and/or eliminating a plunger effect which may resist movement of the FIA 116 within a fluid filled wellbore and/or a fluid filled wellbore tubular. The FFF 136 is represented in FIGS. 1 and 5-7 as a double ended arrow extending through the FIA 116. It will be appreciated that some FFFs 136 may comprise different volumes, may be substantially enlarged, may be substantially shrunken, and/or may otherwise provide different FFF 136 characteristics depending on how the FIA 116 is bent relative to the interior surface 126. For example, in some embodiments, an FFF 136 may provide improved fluid transfer of fluid from downhole of the FIA 116 through the FIA 116 while the FIA 116 is bent during delivery and/or movement in a downhole direction.

Figure 4:
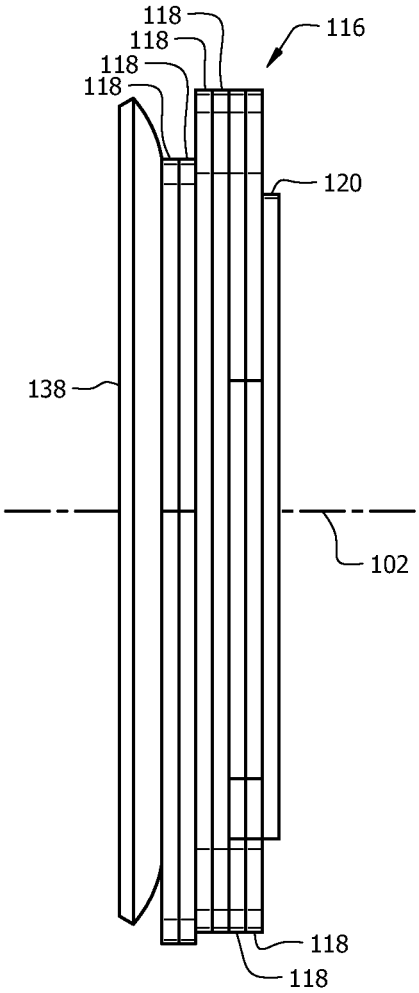
FIG. 4 is an orthogonal side view of a fluid isolator assembly (FIA) according to an embodiment.
Figure 5:
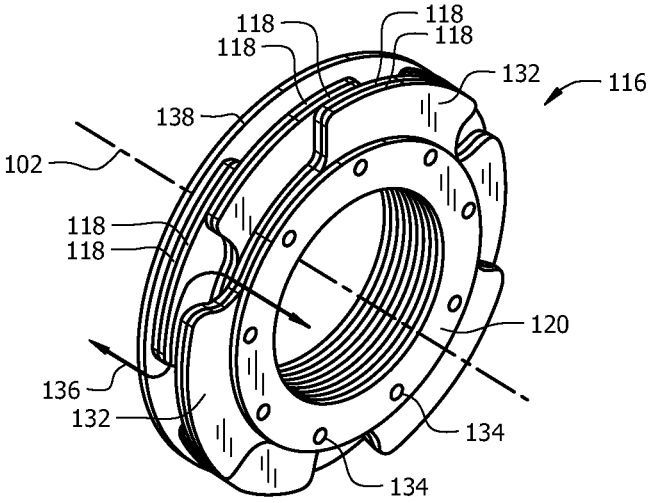
FIG. 5 is an oblique view of the FIA of FIG. 4 from a downhole perspective.
Figure 6:
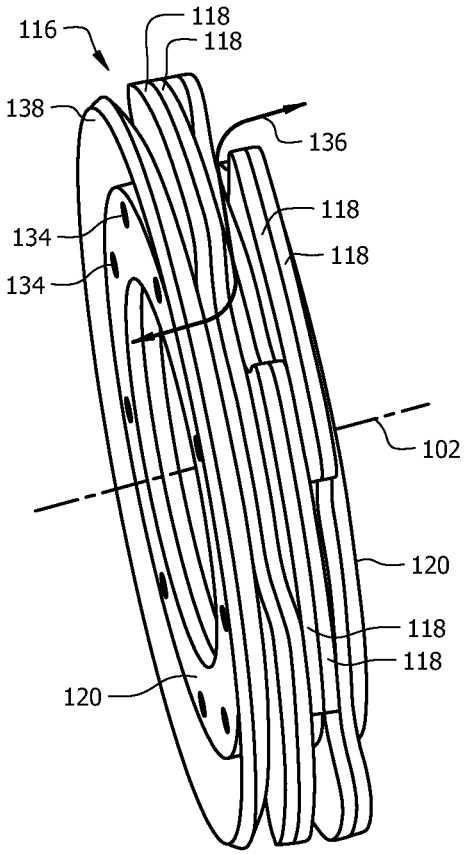
FIG. 6 is an oblique view of the FIA of FIG. 4 from an uphole perspective.
Figure 7:
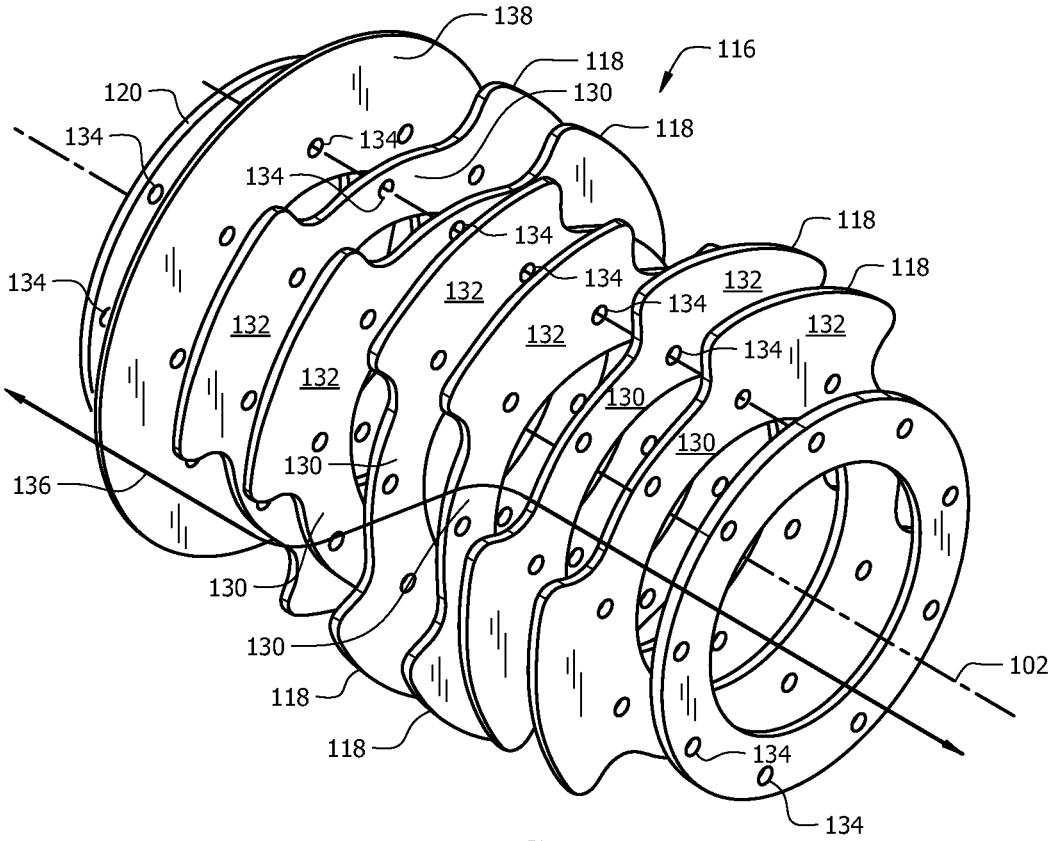
FIG. 7 is an oblique exploded view of the FIA of FIG. 4 from a downhole perspective.

Referring now to FIGS. 4-7, an alternative embodiment of a FIA 116 is shown. FIG. 4 is an orthogonal side view, FIG. 5 is an oblique view from a downhole perspective, FIG. 6 is an oblique view from an uphole perspective, and FIG. 7 is an oblique exploded view from a downhole perspective. FIA 116 also comprises segments 118 and retainer rings 120. However, the FIA 116 of FIGS. 4-7 comprises six segments 118 rather than three segments 118. The layout of segments 118 is substantially similar to that described above with regard to the segments 118 of FIGS. 1 and 2 with the exception that each segment 118 has one adjacent segment 118 that is not angularly offset about the longitudinal axis 102. In other words, the FIA 116 of FIGS. 4-7 may be conceptualized by replacing each one of the segments 118 with two distinct adjacent segments 118. Such arrangement of segments 118 may provide increased stiffness of the FIA 116 while retaining a similar but longitudinally elongated FFF 136 as compared to the FFF 136 of FIG. 1. In this embodiment, FIA 116 further comprises a backstop ring 138. The backstop ring 138 may be configured as an annular ring having an outer diameter configured to selectively contact the interior wall 126. The backstop ring 138 may bend and/or curve in an uphole direction to allow fluid to pass from downhole of the backstop ring 138 to uphole of the backstop ring. For example, the backstop ring is shown in an unbent state in FIGS. 5 and 7 but is shown in a bent and/or curved state in FIGS. 4, 6, and 8-11. In this embodiment, the backstop ring 138 is made of a material substantially similar to that of segments 118 and may serve to limit uphole directed bending of tabs 132 during movement of the FIA 116 in a downhole direction within a wellbore and/or a tubular of a wellbore. Such reinforcement may serve to decrease instances of fluid flow downhole past the FIA 116 without travelling through an FFF 136. In other words, the backstop ring 138 may reduce fluid flow between tabs 132 and interior wall 126. It will be appreciated that any of the components of the DMIT 100 may be constructed of materials and/or combinations of materials chosen to achieve desired mechanical properties, such as, but not limited to, stiffness, elasticity, hardness (for example, as related to the possible need to drill out certain components of a DMIT 100), and resistance to wear and/or tearing. In some embodiments, the body 104 and/or nose 110 may comprise fiberglass and/or aluminum, the retainer rings 120 may comprise aluminum, and/or the segments 118 and/or the backstop ring 138 may comprise rubber.

Figure 8:
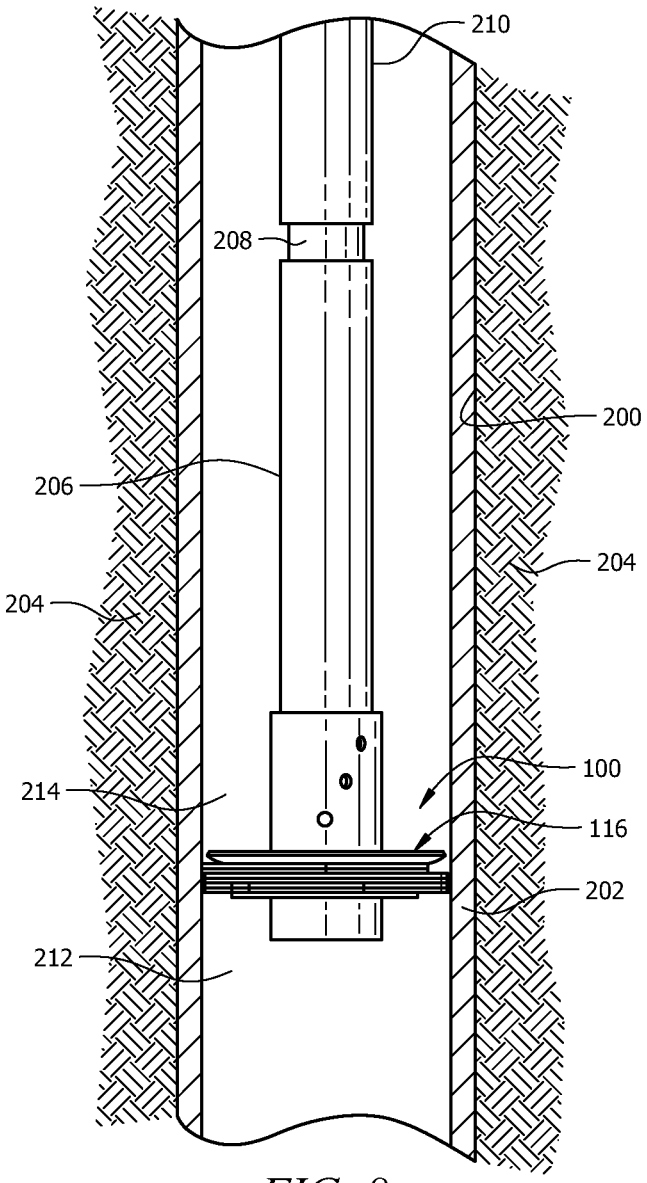
FIG. 8 is a partial cut-away view of the DMIT of FIG. 1 as used in the context of a wellbore for forming a cement plug.

Referring now to FIG. 8, a partial cut-away view of a DMIT 100 as deployed into a wellbore 200 is shown. The wellbore 200 comprises a casing 202 that is substantially fixed in relation to the subterranean formation 204. The DMIT 100 is connected to a lower end of a sacrificial tailpipe 206 and the upper end of the sacrificial tailpipe 206 is connected to a lower end of a disconnect device 208. The upper end of the disconnect device 208 is connected to a tubing string 210 (e.g., production tubing and/or work string). In operation, the above described components may be used to form a cement plug in the wellbore 200 at any desired longitudinal location within the wellbore 200.

To form a cement plug in the wellbore 200, the DMIT 100 may first be assembled to the sacrificial tailpipe 206 and thereafter be lowered into the wellbore 200. As the DMIT 100 is moved downward into the wellbore 200, fluid already present within the wellbore 200 may pass through the FFF 136 of the DMIT 100 from a first wellbore volume 212 (in some embodiments, defined as a volume of the wellbore below and adjacent the FIA 116) into a second wellbore volume 214 (in some embodiments, defined as a volume of the wellbore above and adjacent the FIA 116). Such passage of fluid through the FFF 136 may decrease resistance to movement of the DMIT 100 within the fluid filled wellbore 200. In some embodiments, the sacrificial tailpipe 206 may be provided to have a length substantially equal to a desired length of the cement plug to be created. With the sacrificial tailpipe 206 being connected to the length of tubing string 210 (which is lengthened as the DMIT 100 is lowered downhole) via the disconnect device 208, the DMIT 100 may be lowered into a desired longitudinal location within the wellbore 200.

Once the DMIT 100 is located in the desired position within the wellbore 200, fluid circulation may be established by passing a wellbore servicing fluid (e.g., water and/or other fluids) into the first wellbore volume 212 through the DMIT 100. Once circulation is established, an obturator may be delivered to the DMIT 100 through the tubing string 210 and disconnect device 208 to the seat 112 of the DMIT 100. Upon proper interfacing of the obturator and the seat 112, fluid flow from the DMIT 100 into the first wellbore volume 212 is discontinued and further fluid flow from the DMIT 100 will be directed through the radial ports 108 and into the second wellbore volume 214. Accordingly, cement and spacer fluids may be sent downhole through the tubing string 210 and disconnect device 208 (in some embodiments, followed by a dart and/or wiper). Some of the cement may thereafter be passed from the DMIT 100 into the second wellbore volume 214 and may rise within the wellbore 200 to near a longitudinal location of the top of the sacrificial tailpipe 206. In some embodiments, the cement may be metered so that a volume of cement fills substantially the entire second wellbore volume 214 between the FIA 116 and the upper end of the sacrificial tailpipe 206 as well as filling the interior of the sacrificial tailpipe 206. After such delivery of cement, a fluid pressure may be increased to actuate the disconnect device 208. The disconnect device may be any suitable disconnect device for selectively separating the sacrificial tailpipe 206 from the tubing string 210.

With the cement delivered as described, the cement may be left to settle and/or to set. During the delivery and/or settling and/or setting of the cement, the FIA 116 may serve the role of at least partially serving as a physical boundary between the first wellbore volume 212 and the second wellbore volume 214. In some applications, this at least partial physical separation may serve to stabilize a boundary between the two volumes 212 and 214. More specifically, the FIA 116 may serve to combat fluid instabilities related to at least one of ambient density stratification that may otherwise occur in the absence of the FIA 116, Boycott stratification effect that may otherwise occur in the absence of the FIA 116, and/or any other undesirable comingling of the contents of the two volumes 212 and 214. In a case where the fluid volume within the first wellbore volume 212 spontaneously changes and/or is purposefully altered, the overall structure of the cement plug being formed may be preserved. Such structure is preserved by disconnected sacrificial tailpipe 206 and DMIT 100 being free to move downhole and/or uphole in response to changes in the fluid volume within the first wellbore volume 212. In other words, if fluid is leaking from the first wellbore volume 212 into the formation 204, the DMIT 100 (and the attached sacrificial tailpipe 206) may move downward while still preserving the at least partial isolation of the first wellbore volume 212 from the second wellbore volume 214. In the case where fluid is leaking from the first wellbore volume 212 into a loss feature (e.g. a loss zone and/or leak into the formation through the casing 202), the unhardened cement plug may serve to heal and/or patch and/or otherwise plug the loss feature which may discontinue the downward movement of the cement plug. A result of the above-described method may be a substantially uniform cement plug extending generally from the FIA 116 up to the upper end of the sacrificial tailpipe 206. The above-described method of forming a cement plug may be well suited for permanent and/or temporary abandonment of a wellbore.

Figure 9:
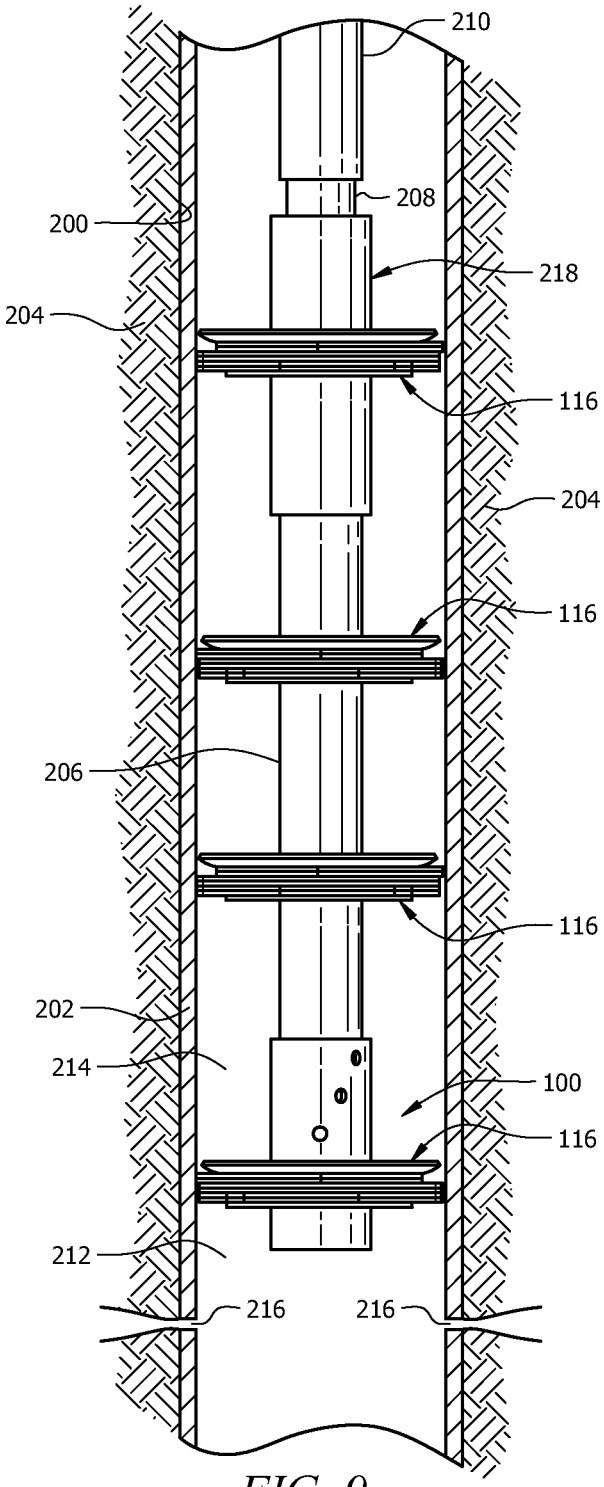
FIG. 9 is a partial cut-away view of a plurality of FIAs of FIG. 1 as used in the context of a wellbore for forming a cement plug to heal a loss feature of the wellbore and showing the FIAs uphole of the loss feature.
Figure 10:
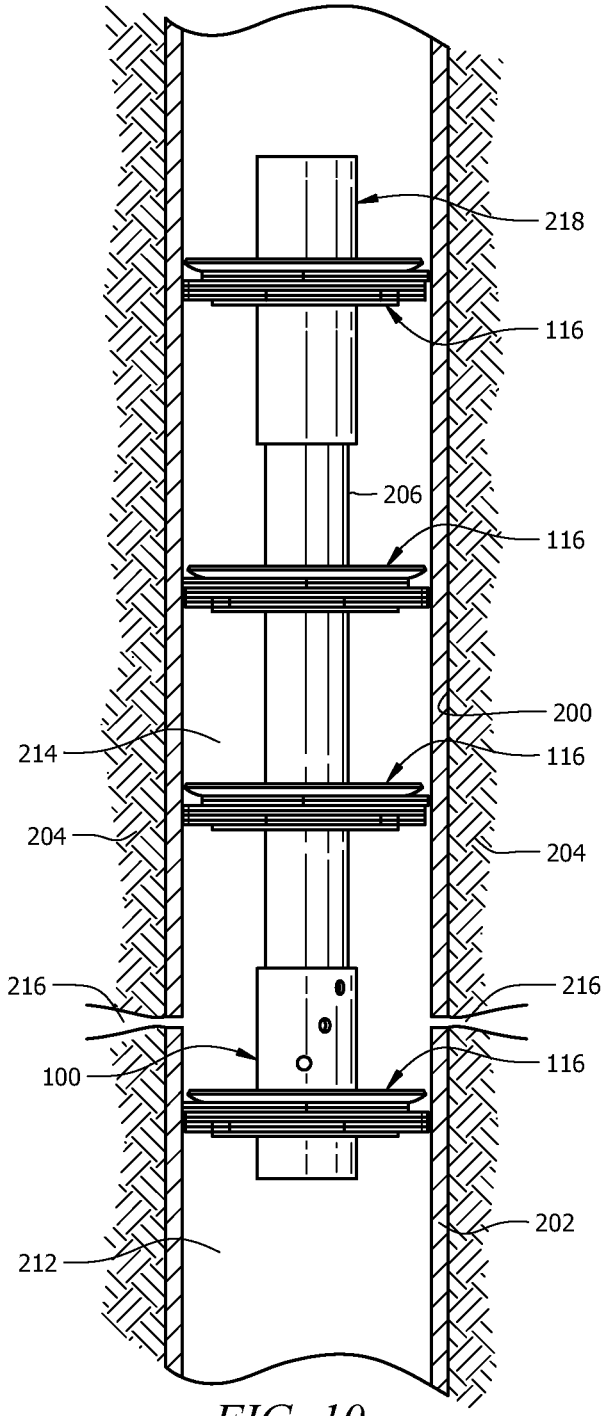
FIG. 10 is a partial cut-away view of the plurality of FIAs of FIG. 9 as used in the context of a wellbore for forming a cement plug to heal a loss feature of the wellbore and showing the FIAs as straddling the loss feature.

Referring now to FIGS. 9 and 10, partial cut-away views of a DMIT 100 and multiple FIAs 116 as deployed into a wellbore 200 are shown. FIGS. 9 and 10 are useful in demonstrating how a DMIT 100 and multiple FIAs 116 may be utilized to heal and/or patch and/or plug loss features 216 of a wellbore 200. The system of FIGS. 9 and 10 is substantially similar to the system of FIG. 8, however, FIGS. 9 and 10 show the use of multiple FIAs 116. In this embodiment, the sacrificial tailpipe 206 is connected at bottom to a DMIT 100. An upper tubular member 218 carries the uppermost FIA 116 and the upper tubular member 218 is connected to the disconnect device 208. By placing the FIAs 116 in the position shown in FIG. 9 relative to the loss features 216, the DMIT 100 and the FIAs 116 may be used to first deliver cement for a cement plug, to later allow migration of the cement between the DMIT 100 and the uppermost FIA 116 into interaction with loss features 216, and to thereafter allow full setting of the cement plug in a location that substantially straddles and/or covers the loss features 216 as shown in FIG. 10.

Operation of the system of FIGS. 9 and 10 may be substantially similar to that described above with relation to FIG. 8 but with the second wellbore volume 214 being substantially captured between a plurality of FIAs 116. In this embodiment, the cement substantially fills the second wellbore volume 214 and the sacrificial tailpipe 206 between an uppermost FIA 116 and a lowest FIA 116 and further filling between intermediate FIAs 116 located between the uppermost FIA 116 and the lowest FIA 116. It will be appreciated that in some embodiments, the intermediate FIAs 116 may be disposed along the sacrificial tailpipe 206. As the number of FIAs 116 increases, a fluid stability within the second wellbore volume 214 may be increased while also serving to ensure improved centralizing and/or standoff effect of the sacrificial tailpipe 206 relative to the casing 202. Further, an increase in the number of FIAs may allow for increased flexibility of the FIAs and/or thinner segments 118 of FIAs 116. A second obturator may be caused to interact with the disconnect device 208 and/or the upper tubular member 218 to actuate the disconnect device 208. After the upper tubular member 218 is disconnected from the disconnect device 208 and the tubing string 210, the DMIT 100, the sacrificial tailpipe 206, and the upper tubular member 218 along with the associated FIAs 116 may be free to migrate downward from the position shown in FIG. 9 to the position shown in FIG. 10 in response to the change in fluid volume within the first wellbore volume 212. During migration of the various FIAs 116 and associated components downward, a wellbore servicing mud may be introduced into the wellbore 200 above the uppermost FIA 116 to keep the wellbore 200 substantially filled with fluid.

Figure 11:
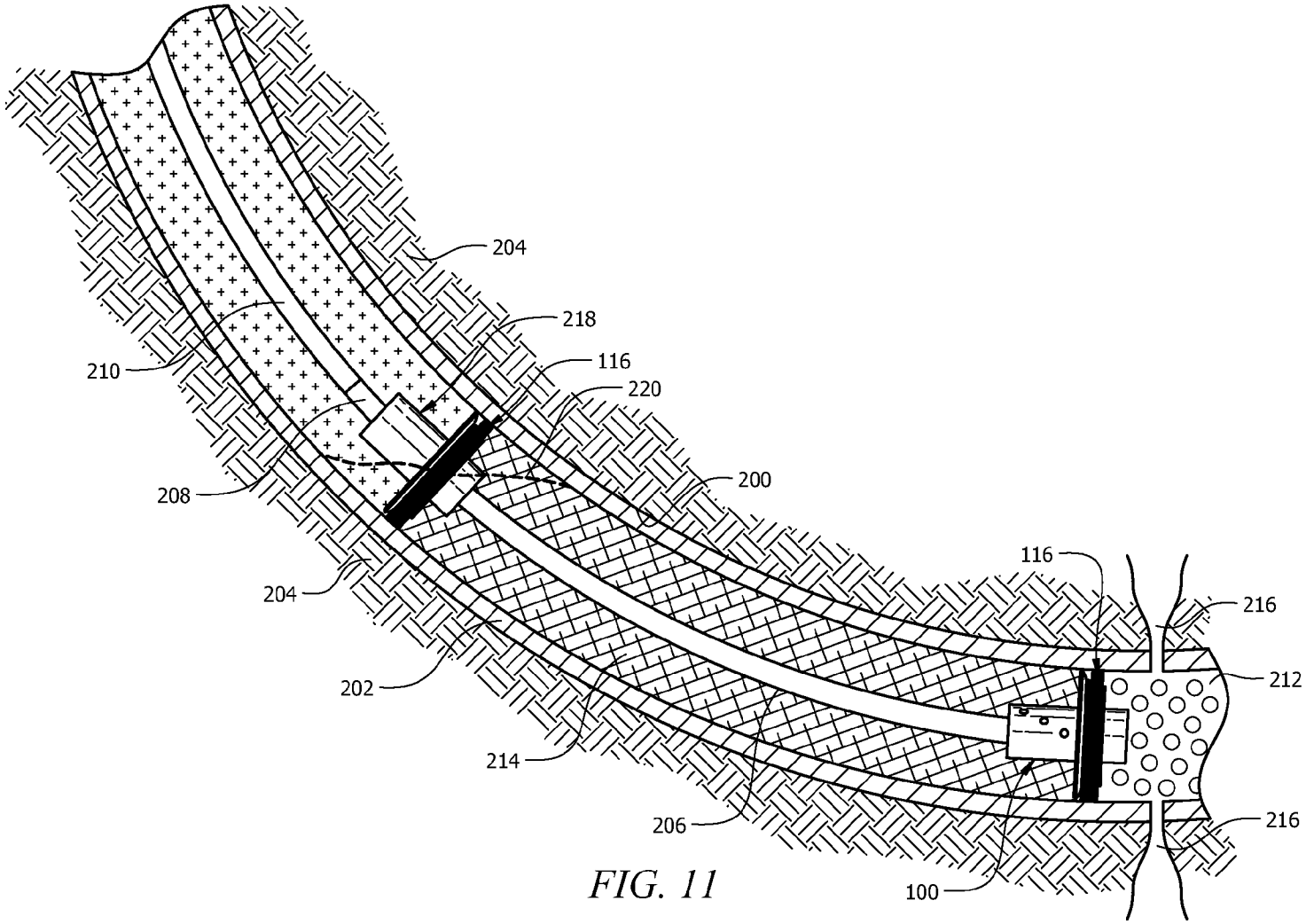
FIG. 11 is a partial cut-away view of a plurality of FIAs of FIG. 1 as used in the context of a horizontal wellbore for forming a cement plug to heal a loss feature of the wellbore and showing the FIAs uphole of the loss feature.

Referring now to FIG. 11, a partial cut-away view of DMIT 100 and the various FIAs 116 as deployed into a wellbore 200 are shown. In this embodiment, the wellbore 200 is a substantially horizontal and/or deviated wellbore 200. Operation and/or implementation of the DMIT 100 and the various FIAs 116 of FIG. 11 is substantially similar to that described above with regard to FIGS. 9 and 10, but FIG. 11 further illustrates a possible benefit of using DMIT 100 and the various FIAs 116 in horizontal and/or deviated wellbore 200 environments. Specifically, through the use of DMIT 100 and the various FIAs 116, a substantially cylindrical shape of a cement plug may be maintained by providing the uppermost FIA 116 that, in this embodiment, is disposed on an upper tubular member 218. In particular, if the uppermost FIA 116 were not present, a cement plug formed using only a lower located FIA 116 may result in the stratification and/or gravity induced leveling and/or Boycott effect stratification of the cement of the plug along the stratification line 220. The uppermost FIA 116 may mitigate such otherwise naturally occurring settling of the cement within the second wellbore volume 214.

It will be appreciated that while the various FIAs 116 described above are referred to as comprising a plurality of segments 118, alternative embodiments of FIAs may comprise a single segment having complex geometry that substantially provides the functionality of the FIAs 116 having multiple segments 118. Further, such an alternative FIA comprising a single segment may similarly comprise a FFF 136 that selectively allows fluids to pass through the FIA having a single segment.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What we claim as our invention is:

1. A method of cementing a wellbore, comprising:

delivering a diversion and movable isolation tool into the wellbore and thereby at least partially isolating a first wellbore volume from a second wellbore volume, the second wellbore volume being uphole relative to the first wellbore volume, wherein during the delivering the diversion and movable isolation tool, fluid is passed through the diversion and moveable isolation tool from the first wellbore volume to the second wellbore volume;

passing fluid through the diversion and movable isolation tool into the first wellbore volume;

substantially discontinuing the passing of fluid through the diversion and movable isolation tool into the first wellbore volume; wherein the substantially discontinuing the passing of fluid comprises interfacing an obturator with the diversion and movable isolation tool;

passing fluid through the diversion and movable isolation tool into the second wellbore volume; and increasing a fluid pressure to disconnect the diversion and movable isolation tool from a delivery device.

2. The method of claim 1, wherein the passing fluid into the first wellbore volume comprises passing fluid through a central bore of the movable isolation tool.

3. The method of claim 1, wherein the passing fluid into the second wellbore volume is performed in response to an obturator being interfaced with the diversion and movable isolation tool.

4. The method of claim 1, wherein after the disconnecting the diversion and movable isolation tool from the delivery device, a longitudinal location of the diversion and movable isolation tool along a length of the wellbore is movable in response to a change of fluid volume within the first wellbore volume.

5. The method of claim 4, wherein a location of the fluid passed through the diversion and movable isolation tool into the second wellbore volume is movable in response to a change of fluid volume within the first wellbore volume.

6. The method of claim 4, further comprising:

introducing a fluid into the wellbore in response to a change of fluid volume within the first wellbore volume.

7. The method of claim 6, wherein the fluid introduced into the second wellbore volume in response to a change of fluid volume within the first wellbore volume comprises a wellbore servicing mud.

8. The method of claim 1, wherein the fluid passed through the diversion and movable isolation tool into the second wellbore volume comprises cement.

9. The method of claim 1, wherein the diversion and movable isolation tool comprises:

a body comprising selectively actuated radial flow ports; and a fluid isolation assembly, comprising:

one or more segments, each segment comprising a central ring and at least one tab extending from the central ring.

10. The method of claim 9, wherein the diversion and movable isolation tool further comprises:

a seat configured for interaction with an obturator so as to selectively actuate the radial flow ports;

retainer rings configured for sandwiching at least one of the one or more segments therebetween; and a fluid flow path extending through the one or more segments.

11. The method of claim 10, wherein a plurality of the one or more segments are angularly located relative to each other and relative to a longitudinal axis of the diversion and moveable isolation tool according to a rotational convention.

12. The method of claim 11, wherein the rotational convention comprises equally angularly offsetting a plurality of the segments about the longitudinal axis.

13. A diversion and movable isolation tool for a wellbore, comprising:

a body comprising selectively actuated radial flow ports and generally defining a longitudinal axis; and a fluid restrictor assembly, comprising:

a plurality of segments, each segment being substantially planar and comprising a central ring and at least one tab extending radially outward from the central ring, wherein a first of the plurality of segments is positioned about the body substantially within a first plane that is about perpendicular to the longitudinal axis and a second of the plurality of segments is positioned about the body substantially within a second plane that is about perpendicular to the longitudinal axis, and wherein the first plane is adjacent to and substantially parallel with the second plane; and retainer rings configured for sandwiching at least one of the one or more segments therebetween.

14. The diversion and movable isolation tool of claim 13, further comprising:

a seat configured for interaction with an obturator to selectively actuate the radial flow ports.

15. The diversion and movable isolation tool of claim 13, wherein at least two of the one or more segments are angularly located relative to each other and rotationally about the longitudinal axis of the diversion and moveable isolation tool according to a rotational convention.

16. The diversion and movable isolation tool of claim 15, wherein the rotational convention comprises equally angularly offsetting at least two of the one or more segments about the longitudinal axis.

17. The diversion and movable isolation tool of claim 13, the fluid isolating assembly further comprising:

a fluid flow path extending through the one or more segments.

18. The diversion and movable isolation tool of claim 13, the fluid isolating assembly further comprising:

a backstop configured to restrict bending of at least one of the tabs.

19. A method of cementing a wellbore, comprising:

diverting a fluid flow from a first wellbore volume to a second wellbore volume using a diversion and movable isolation tool, wherein the diversion and movable isolation tool comprises:

a body comprising selectively actuated radial flow ports; and a fluid isolation assembly, comprising:

one or more segments, each segment comprising a central ring and at least one tab extending from the central ring; and providing a physical barrier between the first wellbore volume and the second wellbore volume using the diversion and movable isolation tool, the physical barrier being movable within the wellbore to remain between the first wellbore volume and the second wellbore volume despite changes in fluid volumes of the first wellbore volume.

20. The method of claim 19, wherein the first wellbore volume is downhole relative to the second wellbore volume.

21. The method of claim 19, wherein the physical barrier comprises the fluid isolation assembly.

22. A method of cementing a wellbore, comprising:

delivering a diversion and movable isolation tool into the wellbore and thereby at least partially isolating a first wellbore volume from a second wellbore volume, the second wellbore volume being uphole relative to the first wellbore volume;

passing fluid through the diversion and movable isolation tool into the first wellbore volume;

substantially discontinuing the passing of fluid through the diversion and movable isolation tool into the first wellbore volume;

passing fluid through the diversion and movable isolation tool into the second wellbore volume; and increasing a fluid pressure to disconnect the diversion and movable isolation tool from a delivery device, wherein after the disconnecting the diversion and movable isolation tool from the delivery service, a longitudinal location of the diversion and movable isolation tool along a length of the wellbore is movable in response to a change of fluid volume within the first wellbore volume.

23. A method of cementing a wellbore, comprising:

delivering a diversion and movable isolation tool into the wellbore and thereby at least partially isolating a first wellbore volume from a second wellbore volume, the second wellbore volume being uphole relative to the first wellbore volume;

passing fluid through the diversion and movable isolation tool into the first wellbore volume;

substantially discontinuing the passing of fluid through the diversion and movable isolation tool into the first wellbore volume; wherein the substantially discontinuing the passing of fluid comprises interfacing an obturator with the diversion and movable isolation tool;

passing fluid through the diversion and movable isolation tool into the second wellbore volume, wherein the fluid passed through the diversion and movable isolation tool into the second wellbore volume comprises cement; and increasing a fluid pressure to disconnect the diversion and movable isolation tool from a delivery device.

24. A diversion and movable isolation tool for a wellbore, comprising:

a body comprising selectively actuated radial flow ports and generally defining a longitudinal axis; and a fluid restrictor assembly, comprising:

a plurality of segments, each segment being substantially planar and comprising a central ring and at least one tab extending radially outward from the central ring, wherein a first of the plurality of segments is positioned about the body substantially within a first plane that is about perpendicular to the longitudinal axis and a second of the plurality of segments is positioned about the body substantially within a second plane that is about perpendicular to the longitudinal axis, and wherein the first plane is adjacent to and substantially parallel with the second plane;

wherein at least two of the one or more segments are angularly located relative to each other and rotationally about the longitudinal axis of the diversion and moveable isolation tool according to a rotational convention; and retainer rings configured for sandwiching at least one of the one or more segments therebetween.

25. The diversion and movable isolation tool of claim 24, wherein the rotational convention comprises equally angularly offsetting at least two of the one or more segments about the longitudinal axis.

26. A diversion and movable isolation tool for a wellbore, comprising:

a body comprising selectively actuated radial flow ports and generally defining a longitudinal axis; and a fluid restrictor assembly, comprising:

a plurality of segments, each segment being substantially planar and comprising a central ring and at least one tab extending radially outward from the central ring, wherein a first of the plurality of segments is positioned about the body substantially within a first plane that is about perpendicular to the longitudinal axis and a second of the plurality of segments is positioned about the body substantially within a second plane that is about perpendicular to the longitudinal axis, and wherein the first plane is adjacent to and substantially parallel with the second plane; and a fluid flow path extending through the one or more segments.

27. A diversion and movable isolation tool for a wellbore, comprising:

a body comprising selectively actuated radial flow ports and generally defining a longitudinal axis; and a fluid restrictor assembly, comprising:

a plurality of segments, each segment being substantially planar and comprising a central ring and at least one tab extending radially outward from the central ring, wherein a first of the plurality of segments is positioned about the body substantially within a first plane that is about perpendicular to the longitudinal axis and a second of the plurality of segments is positioned about the body substantially within a second plane that is about perpendicular to the longitudinal axis, and wherein the first plane is adjacent to and substantially parallel with the second plane; and a backstop configured to restrict bending of at least one of the tabs.

28. A method of cementing a wellbore, comprising:

delivering a diversion and movable isolation tool into the wellbore and thereby at least partially isolating a first wellbore volume from a second wellbore volume, the second wellbore volume being uphole relative to the first wellbore volume;

wherein the diversion and movable isolation tool comprises a body comprising selectively actuated radial flow ports and a fluid isolation assembly comprising one or more segments, each segment comprising a central ring and at least one tab extending from the central ring;

passing fluid through the diversion and movable isolation tool into the first wellbore volume;

substantially discontinuing the passing of fluid through the diversion and movable isolation tool into the first wellbore volume;

passing fluid through the diversion and movable isolation tool into the second wellbore volume; and increasing a fluid pressure to disconnect the diversion and movable isolation tool from a delivery device.

29. The method of claim 28, wherein the diversion and movable isolation tool further comprises:

a seat configured for interaction with an obturator so as to selectively actuate the radial flow ports;

retainer rings configured for sandwiching at least one of the one or more segments therebetween; and a fluid flow path extending through the one or more segments.

30. The method of claim 29, wherein a plurality of the one or more segments are angularly located relative to each other and relative to a longitudinal axis of the diversion and moveable isolation tool according to a rotational convention.

31. The method of claim 30, wherein the rotational convention comprises equally angularly offsetting a plurality of the segments about the longitudinal axis.

* * * * *